US009972462B1

(12) United States Patent
Chen et al.

(10) Patent No.: US 9,972,462 B1
(45) Date of Patent: May 15, 2018

(54) MECHANICAL SWITCH STRUCTURE

(71) Applicants: LITE-ON ELECTRONICS (GUANGZHOU) LIMITED, Guangzhou (CN); LITE-ON TECHNOLOGY CORPORATION, Taipei (TW)

(72) Inventors: Chun-Lin Chen, Taipei (TW); Ko-Hsiang Lin, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days. days.

(21) Appl. No.: 15/643,568

(22) Filed: Jul. 7, 2017

(30) Foreign Application Priority Data

Jan. 13, 2017 (CN) ..... 2017 1 0026102

(51) Int. Cl.

| | |
|---|---|
| ***H01H 13/52*** | (2006.01) |
| ***H01H 13/04*** | (2006.01) |
| ***H01H 13/14*** | (2006.01) |
| *H01H 13/70* | (2006.01) |

(52) U.S. Cl.
CPC ..... *H01H 13/52* (2013.01); *H01H 13/04* (2013.01); *H01H 13/14* (2013.01); *H01H 13/70* (2013.01); *H01H 2233/07* (2013.01); *H01H 2235/01* (2013.01)

(58) Field of Classification Search
CPC ..... H01H 13/52; H01H 13/04; H01H 13/14; H01H 13/70; H01H 2233/07; H01H 2235/01; H01H 13/10; H01H 13/83; H01H 2219/044; H01H 2219/062; H01H 2219/064; H01H 2229/02; H01H 2219/066
USPC ..... 200/344, 5 A, 314, 517
See application file for complete search history.

(56) References Cited

U.S. PATENT DOCUMENTS

| | | | | |
|---|---|---|---|---|
| 5,793,311 | A * | 8/1998 | Wood | H01H 13/70 200/181 |
| 8,692,147 | B2 * | 4/2014 | Chen | H01H 13/83 200/314 |
| 2013/0049995 | A1 * | 2/2013 | Wu | H01H 13/83 341/22 |

FOREIGN PATENT DOCUMENTS

| | | |
|---|---|---|
| TW | 175196 | 11/1991 |
| TW | 244025 | 3/1995 |
| TW | 244644 | 4/1995 |
| TW | 200719371 | 5/2007 |

(Continued)

*Primary Examiner* — Edwin A. Leon
(74) *Attorney, Agent, or Firm* — Li & Cai Intellectual Property (USA) Office

(57) ABSTRACT

A mechanical switch structure includes a keycap, a base plate formed with a guiding opening, a scissor unit disposed on the base plate, and a receiving housing. The receiving housing has a first accommodation and a second accommodation. A guiding unit is received in the first accommodation along a pressing direction of the keycap, and is formed with a hillside portion. A first elastic element provides the guiding unit with an elastic force. A resistance module has an abutting unit which is abutted against the hillside portion of the guiding unit, and a second elastic unit to provide the abutting unit with an elastic force toward the guiding unit. The hillside portion is undulate-shaped and faces the guiding unit. The abutting unit is abutted against the hillside portion so as to provide different resistances during a pressing stroke of the keycap.

14 Claims, 11 Drawing Sheets

(56) References Cited

FOREIGN PATENT DOCUMENTS

| | | | |
|---|---|---|---|
| TW | M314377 | | 6/2007 |
| TW | 201517092 | A | 5/2015 |
| TW | 201633343 | A | 9/2016 |
| TW | 201640545 | A | 11/2016 |

* cited by examiner

MECHANICAL SWITCH STRUCTURE

BACKGROUND OF THE INVENTION

1. Field of the Invention

The present disclosure is related to a mechanical switch structure, and in particular, to a mechanical switch structure for outputting a signal or command by pressing a key, which can be applied on, for example, a keyboard of a computer.

2. Description of Related Art

Keyboards have become a very common computer periphery equipment, and can be divided into two general types: mechanical type keyboards and membrane type keyboards. The membrane type keyboard has a keycap, a scissor frame under the keycap, an elastic element, and a circuit membrane on a bottom of the keyboard. When the keycap is pressed, the elastic element is pressed by the keycap downward to contact the circuit membrane, so as to produce and output a signal. A drawback of the membrane type keyboard is that, if a single circuit belonging to a single key is damaged, the entire circuit membrane needs to be replaced or even becomes irreparable, with no option of replacing a single key available. In addition, the operating tactility is decided by the elastic element, and since a distance of the pressing stroke is short with an unapparent tactile feedback, the tactility of the membrane type keyboard is relatively poor when compared with the mechanical type keyboard.

The mechanical type keyboard has a mechanical switch to produce a signal. It has the advantages of providing a specific tactile feedback when a key is pressed, and a long lifespan.

The current mechanical type keyboard usually has a spring structure disposed on a central axle. The height of the spring structure is generally higher than that of membrane type keyboard. In addition, its elasticity graph during a pressing stroke has a curve line curved downward after passing a "peak point" until reaching a valley where lies an "operating point," and a diagonal line extending gradually upward. No apparent tactile sensation of bump feedback is present in the current mechanical type keyboard.

SUMMARY OF THE INVENTION

One objective of the present disclosure is to provide a mechanical switch structure, which can reduce a total height of a mechanical switch structure, and increase the stability of operation.

Another objective of the present disclosure is to provide a mechanical switch structure, which can provide a noticeable tactile feedback when pressing the mechanical switch structure.

In order to achieve the above objectives, according to one exemplary embodiment of the present disclosure, a mechanical switch structure is provided, which includes a keycap, a base plate disposed under the keycap, a scissor unit disposed between the keycap and the base plate to guide the keycap up or down along a pressing direction, a receiving housing connected to a bottom of the base plate, a guiding unit, a first elastic element and a resistance module. The base plate has a guiding opening formed thereon. The receiving housing has a first accommodation corresponding to the guiding opening, and a second accommodation formed at one side of the first accommodation. The guiding unit is movably received in the first accommodation along the pressing direction of the keycap, and in the guiding opening. A periphery of the guiding unit is formed with a hillside portion. The first elastic element has two ends respectively abutted against the guiding unit and the first accommodation, so as to provide the guiding unit with an elastic force parallel to the pressing direction. The resistance module has an abutting unit and a second elastic unit. The abutting unit is abutted against the hillside portion of the guiding unit. The hillside portion has an undulation surface facing the abutting unit. The second elastic unit is received in the second accommodation and provides the abutting unit with an elastic force toward the guiding unit. The abutting unit is abutted against the undulation surface of the hillside portion to provide different resistive forces during a pressing stroke of the keycap.

Thus, the present disclosure has advantages as follows. The present disclosure can reduce a total height of the mechanical switch structure, and increase the stability of operation by the scissor unit. According to the present disclosure, the mechanical switch structure can provide noticeable tactile sensation by the hillside portion of the guiding unit abutting against the abutting unit of the resistance module, and the hillside portion has an undulation surface facing the abutting unit to provide a noticeable tactile sensation.

For a further understanding of the present disclosure, reference is made to the following detailed description illustrating the embodiments and examples of the present disclosure. The description is for illustrative purpose only and is not intended to limit the scope of the claim.

DETAILED DESCRIPTION OF THE EXEMPLARY EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1:
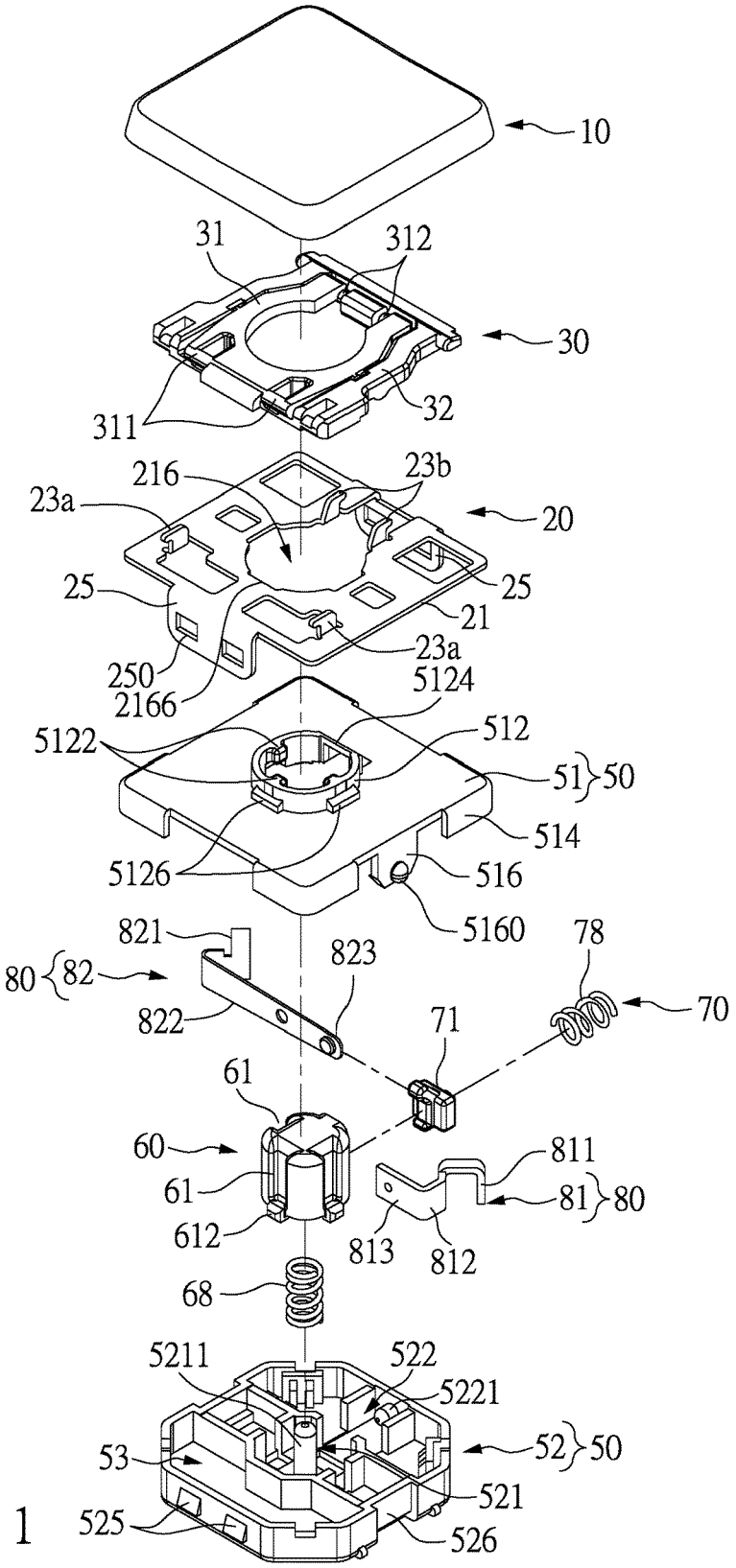
FIG. 1 is an exploded perspective view of a mechanical switch structure of the present disclosure.
Figure 2:
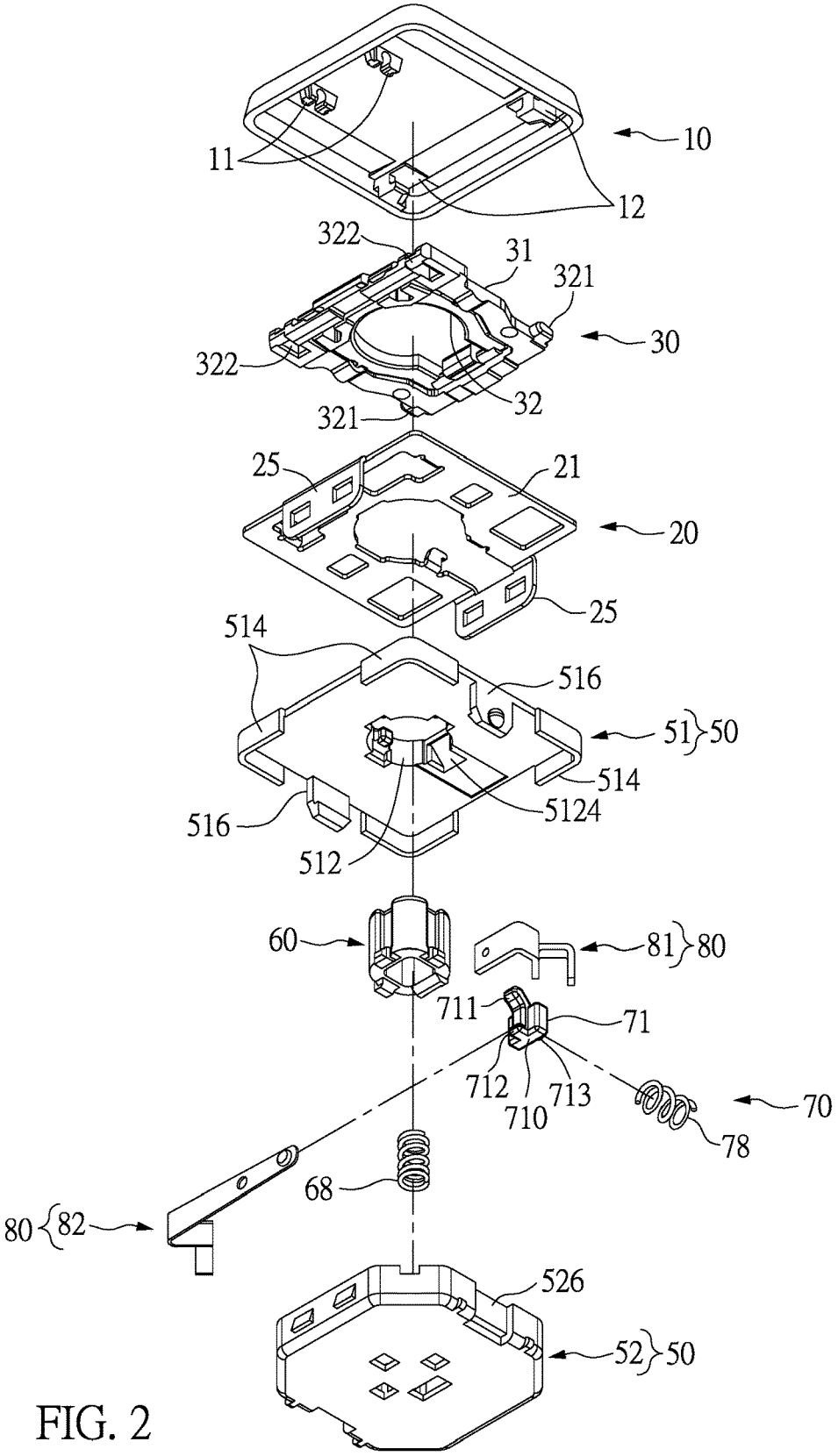
FIG. 2 is another exploded perspective view of the mechanical switch structure of the present disclosure.

Reference is made to FIGS. 1 and 2, which are perspective views of a mechanical switch structure of the present disclosure. The present invention provides a mechanical switch structure, which includes a keycap 10, a base plate 20 disposed under the keycap 10, a scissor unit 30 arranged between the keycap 10 and the base plate 20, a receiving housing 50 connected a bottom of the base plate 20, a guiding unit 60, a first elastic element 68, and a resistance module 70.

The base plate 20 has a main body 21, and a plurality of linking portions 23*a*, 23*b* protruded upward from the main body 21 toward the keycap 10. The base plate 20 has a guiding opening 216 formed on the main body 21. In this embodiment, the base plate 20 can be formed by punching of a metal board.

As shown in FIG. 2, a bottom of the keycap 10 has a plurality of connecting portions 11, 12. In this embodiment, the scissor unit 30 is a scissor-type structure, which is used to guide the keycap 10 along a pressing direction upward or downward. The scissor unit 30 has a first frame 31 and a second frame 32 pivotally connected to the first frame 31. Two sides of the first frames 31 and two sides of the second frame 32 are connected to the linking portions 23*a*, 23*b* and the connecting portions 11, 12. As shown in FIG. 1, the first frame 31 has a plurality of first axles 311, 312 on an upper and a lower side thereof, which are pivotally connected to the connecting portions 11 of the keycap 10 and the linking portions 23*b* of the base plate 20. As shown in FIG. 2, the second frame 32 has a plurality of second axles 321, 322 on an upper and a lower side thereof, which are pivotally connected to the connecting portions 12 of the keycap 10 and the linking portions 23*a* of the base plate 20. Therefore, this embodiment can reduce the total height of the mechanical switch structure, and increase the stability of operation.

In addition, the base plate 20 further has a pair of engaging flaps 25. Each engaging flap 25 has two engaging holes 250. The pair of the engaging flaps 25 are extended downward from two sides of the base plate 20 and fixedly engaged with the receiving housing 50.

In this embodiment, the receiving housing 50 includes an upper housing 51 and a lower housing 52. The receiving housing 50 includes a first accommodation 521 corresponding to the guiding openings 216, and a second accommodation 522 arranged at one side of the first accommodation 521. The first accommodation 521 and the second accommodation 522 are formed between the upper housing 51 and the lower housing 52, and surrounded by a plurality of partitions (not labeled) therein.

The upper housing 51 of the receiving housing 50 includes a plurality of side walls 514 extended downward, and a pair of retaining tabs 516 extended downward. The pair of retaining tabs 516 are engaged with the bottom end of the buckling portion 526 of the lower housing 52 (as shown in FIG. 2). The height of the side walls 514 is lower than the height of the lower housing 52. The upper housing 51 has a contour along a vertical projecting direction which is a substantially square shaped. The lower housing 52 has a contour along a vertical projecting direction which is substantially polygonal in shape.

Figure 3:
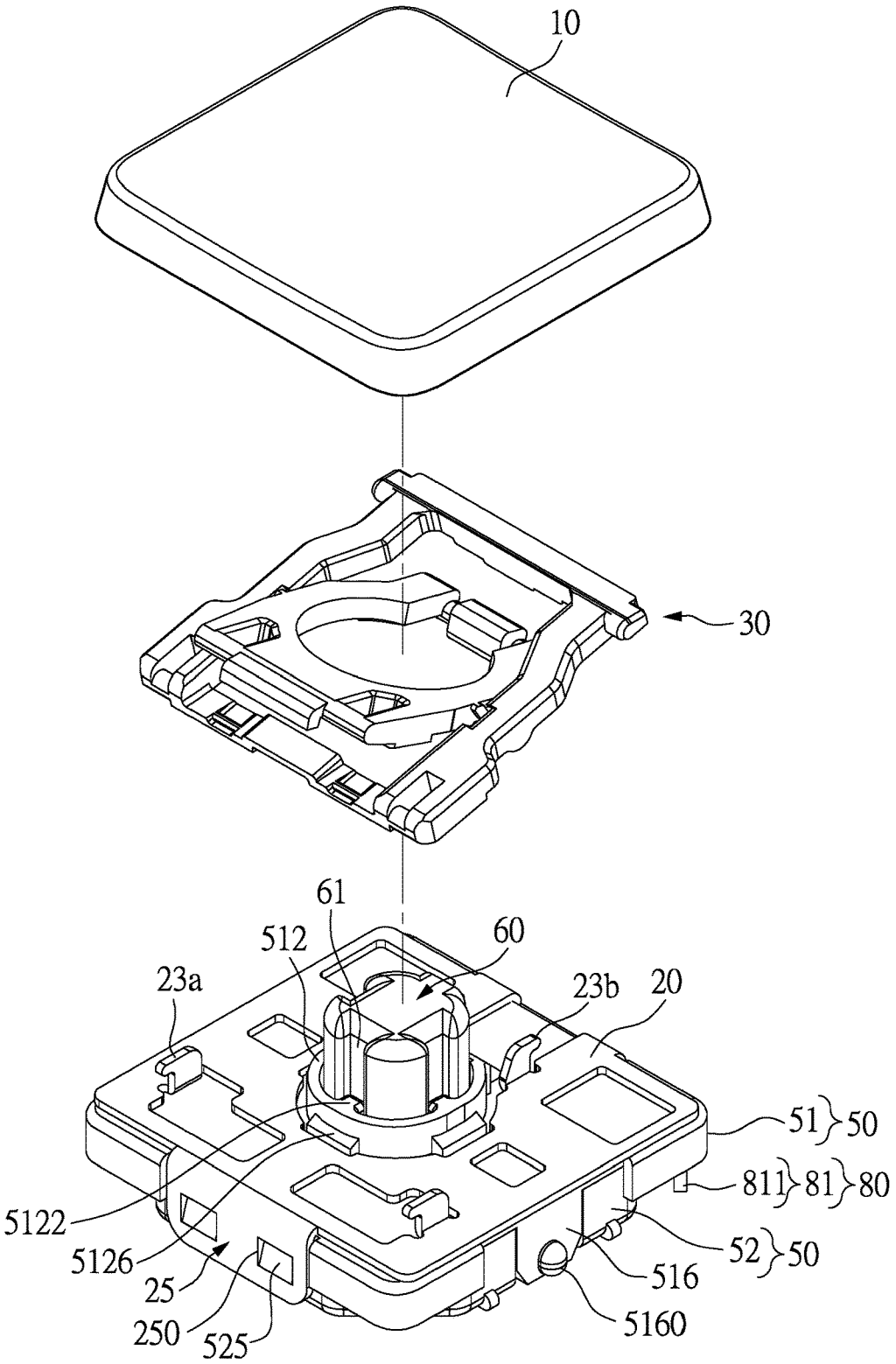
FIG. 3 is a partial-assembled perspective view of the mechanical switch structure of the present disclosure.

The guiding unit 60 is movably received in the first accommodation 521 of the receiving housing 50 along the pressing direction of the keycap 10, and passes through the guiding opening 216. Referring to FIG. 1 and FIG. 4A, the first accommodation 521 has a guiding post 5211, and the first elastic element 68 is put on the guiding post 5211. The guiding unit 60 is put on the first elastic element 68. An assembled perspective view of the base plate 20, the receiving housing 50 and the guiding unit 60 of this embodiment is as shown in FIG. 3. The retaining tabs 25 are engaged with the engaging hooks 525 of the lower housing 52.

Figure 4:
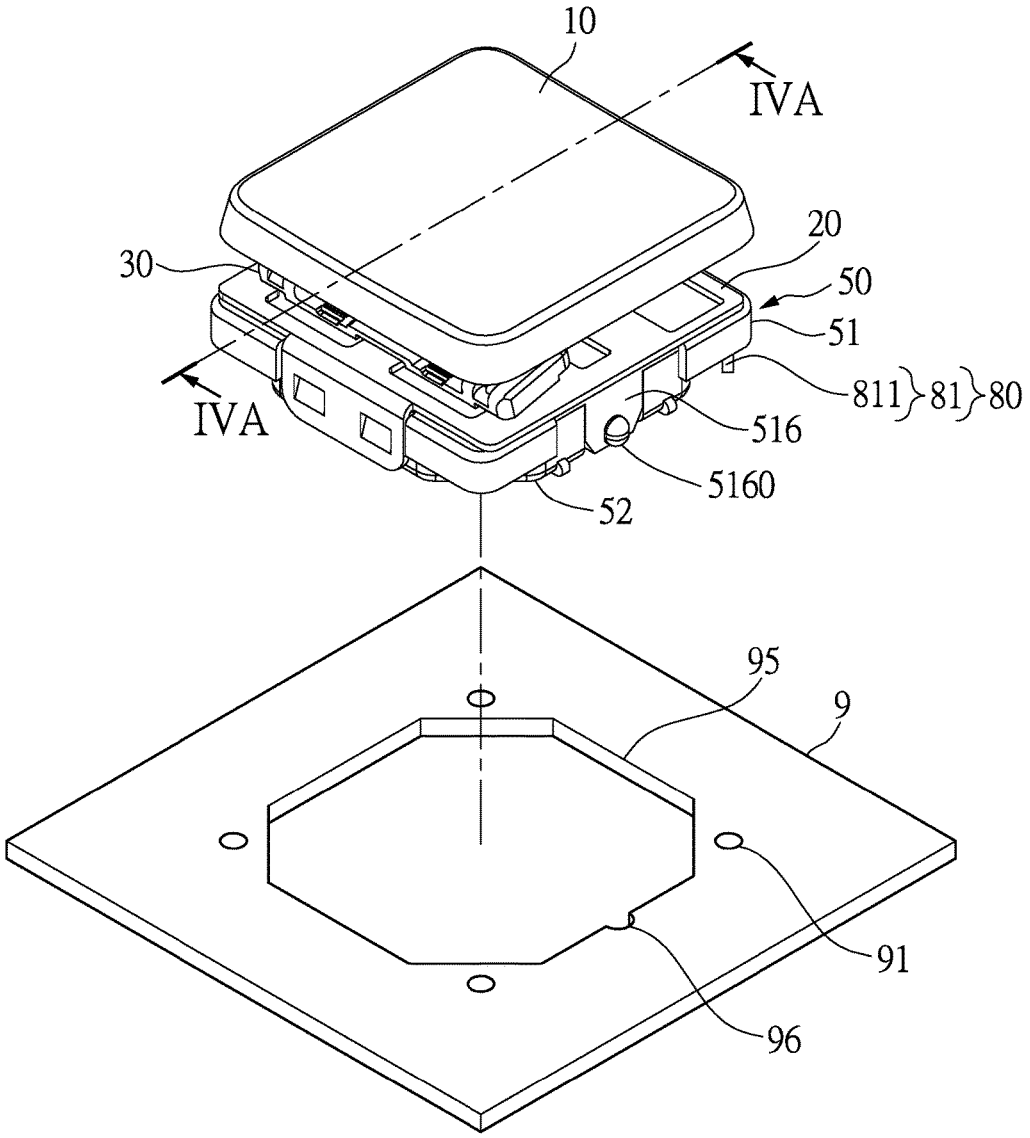
FIG. 4 is an assembled perspective view of the mechanical switch structure of the present disclosure.
Figure 4A:
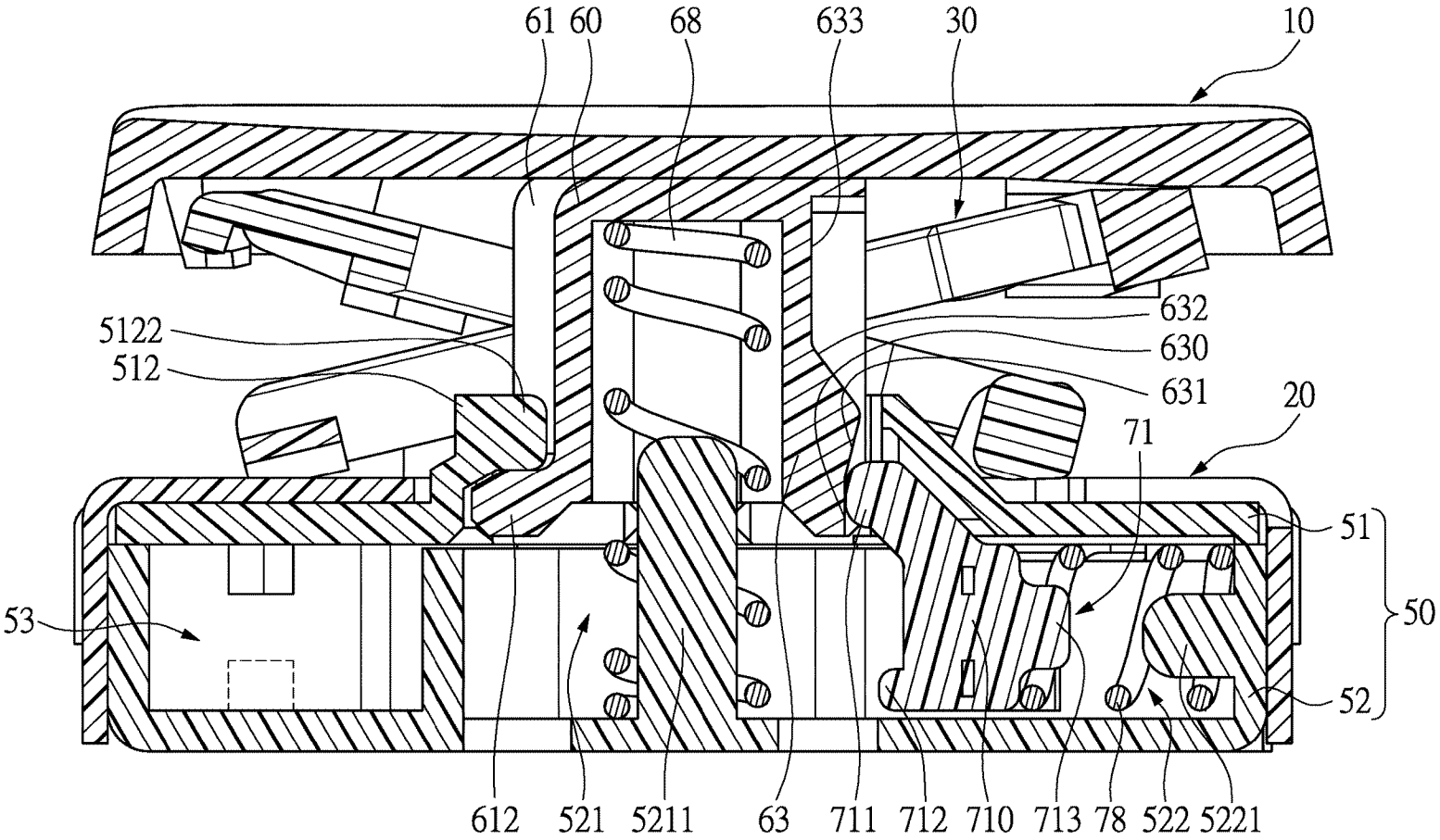
FIG. 4A is a cross-sectional view of the mechanical switch structure in a non-pressed state of the present disclosure.

Reference is made to FIG. 4, which is a perspective view of the mechanical switch structure and a circuit membrane layer of the present disclosure. The circuit membrane layer 9 corresponds with a contour of the lower housing 52, and has a fitting opening 95 which is substantially polygonal in shape, and an identify notch 96 formed at one side of the fitting opening 95. The circuit membrane layer 9 further has a plurality of soldering thru-holes 91. The receiving housing 50 further has an identification protrusion 5160 protruded from one of the retaining tabs 516. Thus, a user can align the identification protrusion 5160 with an identify notch 96 of the circuit membrane layer 9 when assembling the mechanical switch structure of the present disclosure on the circuit membrane layer 9.

Figure 1A:
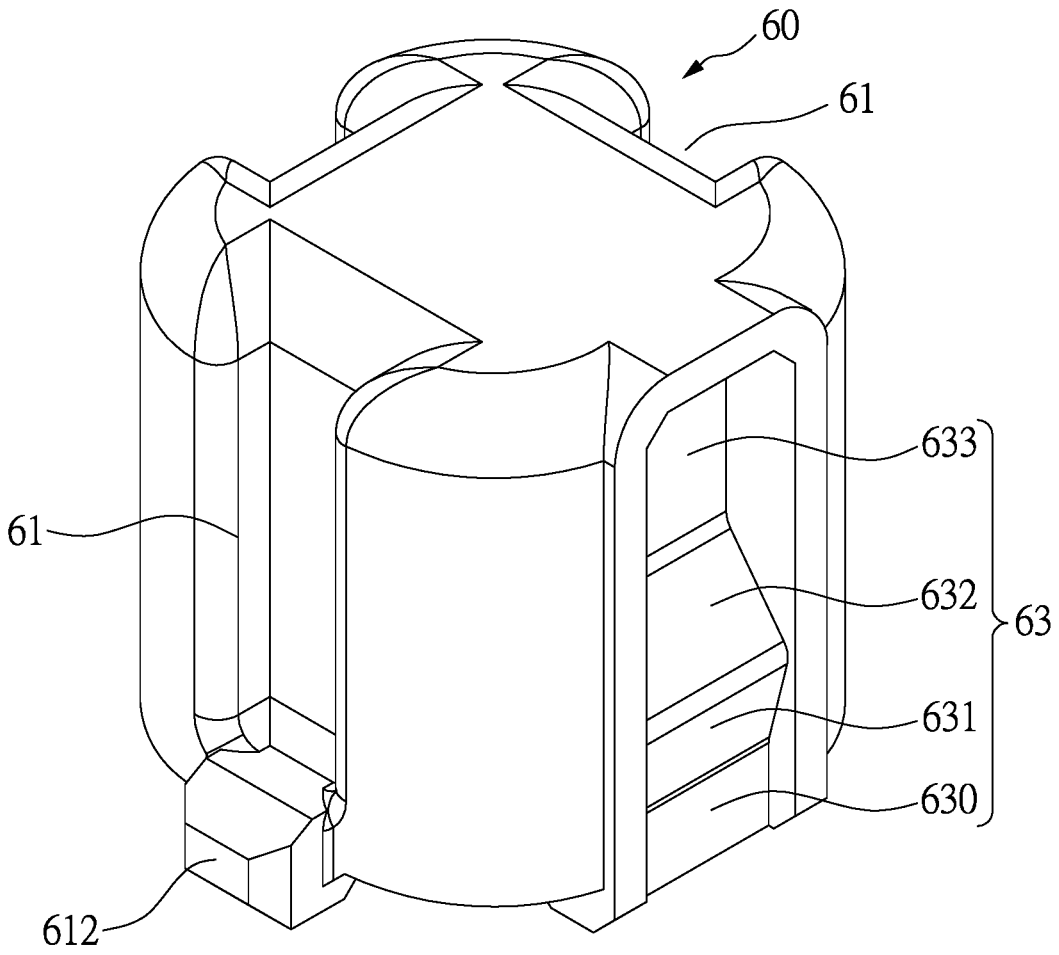
FIG. 1A is a perspective view of a guiding unit of the mechanical switch structure of the present disclosure.

As shown in FIG. 1A and FIG. 4A, the guiding unit 60 has a hillside portion 63 which is formed on a periphery thereof. The guiding unit 60 can help to guide and restrict the keycap 10 in a moving direction during a pressing travel. In addition, the guiding unit 60 in this embodiment can be operated with the resistance module 70 and further provides a pressing tactile feedback much like a mechanical switch by the hillside portion 63, which is described in detail as follows.

First, the guiding unit 60 guides and restricts the moving direction of the keycap 10. As shown in FIG. 1 to FIG. 3, the upper housing 51 has an enclosing wall 512 protruded upward therefrom. The guiding unit 60 is a hollow column and movably passes through the enclosing wall 512. A top of the guiding unit 60 is abutted against a bottom of the keycap 10. The guiding unit 60 has a plurality of guiding grooves 61 formed on a periphery thereof, and a plurality of blocking portions 612 formed at a bottom end of the guiding grooves 61, respectively. The enclosing wall 512 has a plurality of stopping protrusions 5122 protruded inward, and the stopping protrusions 5122 are located in the guiding grooves 61, respectively. The stopping protrusions 5122 can prevent the guiding unit 60 from dislocating away from the receiving housing 50. The enclosing wall 512 has a plurality of snapping tenons 5126 protruded outward, and the guiding opening 216 is formed with snapping cutouts 2166 correspondingly. For assembly, the snapping tenons 5126 are arranged in the snapping cutouts 2166 respectively, so that the base plate 20 can be assembled with the receiving housing 50 more stably to avoid swinging. The first elastic element 68 has two ends which are respectively abutted against the guiding unit 60 and the first accommodation 521, so as to provide the guiding unit 60 with an elastic force parallel the pressing direction.

In addition, the guiding unit 60 can be operated with the resistance module 70 to provide a pressing tactile sensation like a mechanical switch. As shown in FIG. 1, FIG. 1A and FIG. 2, the resistance module 70 has an abutting unit 71 and a second elastic unit 78. The abutting unit 71 is abutted against the hillside portion 63 of the guiding unit 60. The hillside portion 63 has an undulation surface facing the abutting unit 71. The second elastic unit 78 is received in the second accommodation 522 and provides the abutting unit 71 with an elastic force toward the guiding unit 60. In this embodiment, the second accommodation 522 further has a protruding rod 5221. The other end of the second elastic unit 78 is fixed to the protruding rod 5221. The abutting unit 71 is abutted against the undulation surface of the hillside portion 63. During a pressing travel of the keycap 10, the second elastic unit 78 is pushed by the hillside portion 63 in different compressing conditions, so that there are different resistive forces between the abutting unit 71 and the undulation surface of the hillside portion 63. In other words, different resistive forces are exerted upon the keycap 10 during the pressing stroke, so as to provide multiple levels of noticeable tactile sensations.

Figure 4B:
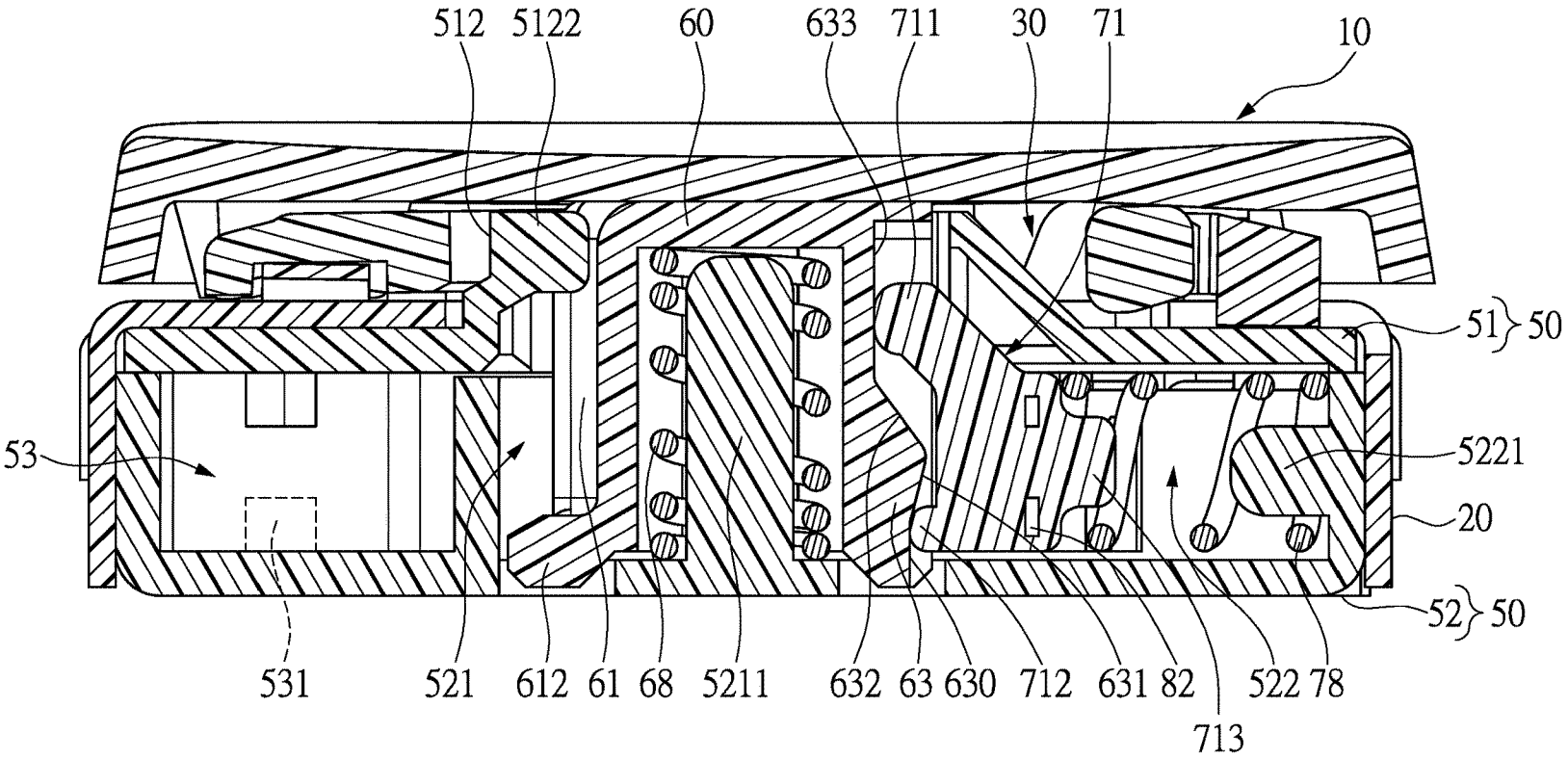
FIG. 4B is a cross-sectional view of the mechanical switch structure in a pressed state of the present disclosure.

Reference is made to FIG. 4A and FIG. 4B, which is a cross-sectional view along line IVA-IVA in FIG. 4 according to the present disclosure. In this embodiment, a moving direction of the abutting unit 71 is substantially perpendicular to the pressing direction. The abutting unit 71 has a main portion 710, and an upper abutting portion 711 protruded from the main portion 710 toward the guiding unit 60. The upper abutting portion 711 is near the guiding opening 216 of the base plate 20, and is continuously abutted against the hillside portion 63. The abutting unit 71 further has a holding portion 713 formed at one side of the main portion 710, and a lower abutting portion 712. The lower abutting portion 712 is protruded from the main portion 710 toward the guiding unit 60 and disposed close to the upper abutting portion 711. The holding portion 713 is opposite to the upper abutting portion 711 and fixed to one end of the second elastic unit 8. The lower abutting portion 712 is disposed close to a bottom of the receiving housing 50. When the keycap 10 is pressed to a bottommost position, the lower abutting portion 712 is abutted against the hillside portion 63, as shown in FIG. 4B.

A further description of the upper housing 51 of the receiving housing 50, as shown in FIG. 1 to FIG. 2, the enclosing wall 512 has a restricting portion 5124 protruded therefrom, which has a shape corresponding with the upper abutting portion 711 of the abutting unit 71, so that the upper abutting portion 711 can be guided and restricted in the restricting portion 5124 after the abutting unit 71 is pushed outward by the hillside portion 63.

Reference is made to FIG. 4A and FIG. 4B. The hillside portion 63 of the guiding unit 60 is detailed as follows, which has, in the order from the bottom of the guiding unit 60 toward the keycap 10, an initial surface 630 parallel to the pressing direction, a first sloping surface 631 connected to the initial surface 630, a second sloping surface 632 curvedly connected to the first sloping surface 631, and a rear surface 633 extended from the second sloping surface 632 parallel to the pressing direction. A slope of the first sloping surface 631 related to the pressing direction is different from a slope of the second sloping surface 632 related to the pressing direction. In this embodiment, the initial surface 630 and the rear surface 633 are parallel to the pressing direction, and the initial surface 630 is closer to the abutting unit 71 than the rear surface 633.

As shown in FIG. 4B, when the keycap 10 is pressed to the bottommost position, the upper abutting portion 711 is abutted against the rear surface 633 of the hillside portion 63, and the lower abutting portion 712 is abutted against the initial surface 630 of the hillside portion 63. Therefore, the guiding unit 60 can move stably up or down.

Refer to FIG. 1 to FIG. 3, and FIG. 6. The switching module 80 of the mechanical switch structure is detailed as follows. In this embodiment, the switching module 80 has a first conducting arm 81 and a second conducting arm 82. The second conducting arm 82 is fixedly connected to the abutting unit 71, and the first conducting arm 81 is positioned at one side of the abutting unit 71. When the abutting unit 71 is abutted against the hillside portion 63 and is moved, the abutting unit 71 pushes the second conducting arm 82 against the first conducting arm 81 to produce a pressing signal.

The first conducting arm 81 has a main portion which is received in the receiving housing 50. The main portion of the first conducting arm 81 has a first soldering portion 811, a first extending portion 812 and a first contacting portion 813. The first soldering portion 811 is disposed at one side of the second accommodation 522 and extended outside the receiving housing 50. The first extending portion 812 extends from the first soldering portion 811 and traverses across the second accommodation 522. The first contacting portion 813 is disposed at an end of the first extending portion 812.

The second conducting arm 82 is received in the receiving housing 50. The second conducting arm 82 has a second soldering portion 821, a second extending portion 822, and a second contacting portion 823. The second soldering portion 821 is fixed to one side of the second accommodation 522 and extended outside the receiving housing 50. The second extending portion 822 is extended from the second soldering portion 821. The second contacting portion 823 is extended from the second soldering portion 822 and is near to the first contacting portion 813. The second extending portion 822 is passed through the abutting unit 71. In this embodiment, the second extending portion 822 can be combined with the abutting unit 71 by an insert molding method, but is not limited thereto. Other methods can also be used to achieve the same, such as hot melt connection, adhesive connection, etc.

Figure 4C:
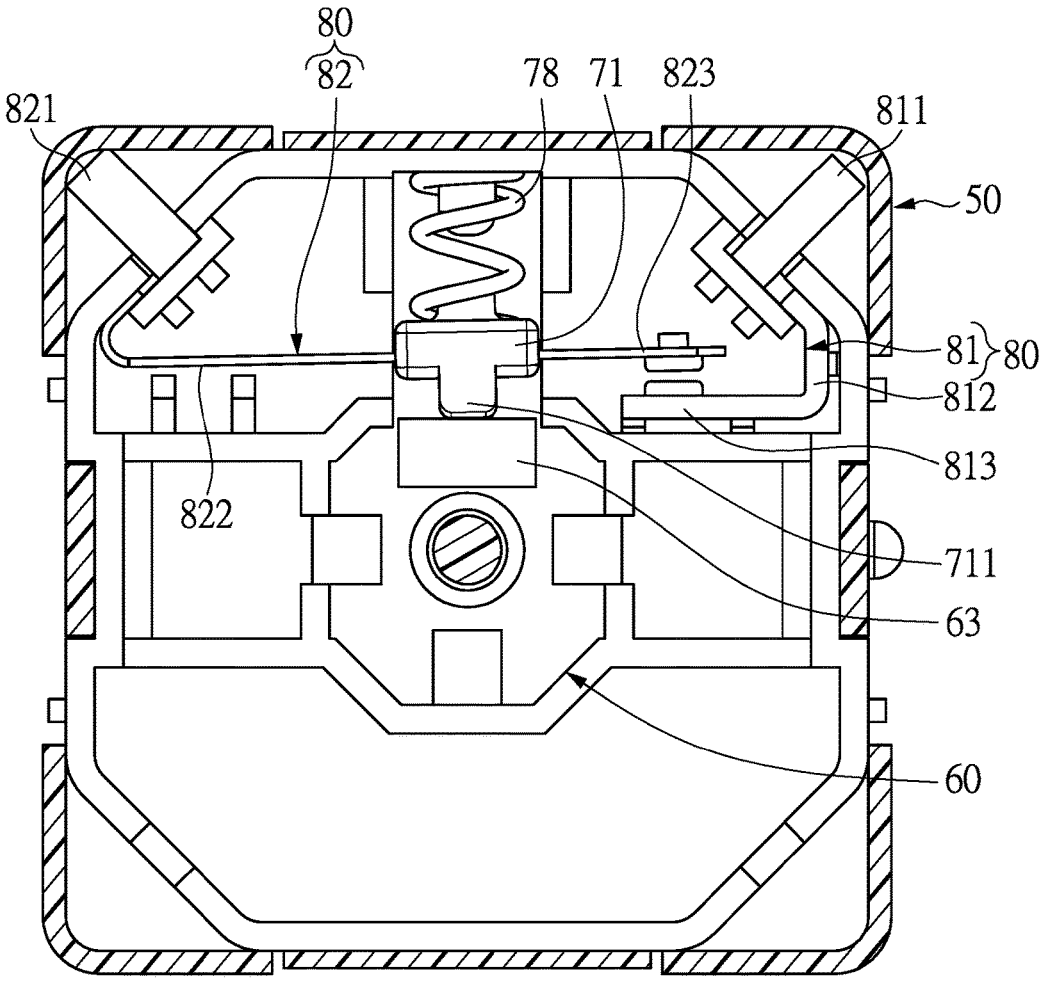
FIG. 4C is a cross-sectional view of the mechanical switch structure along a horizontal surface in a non-pressed state of the present disclosure.
Figure 4D:
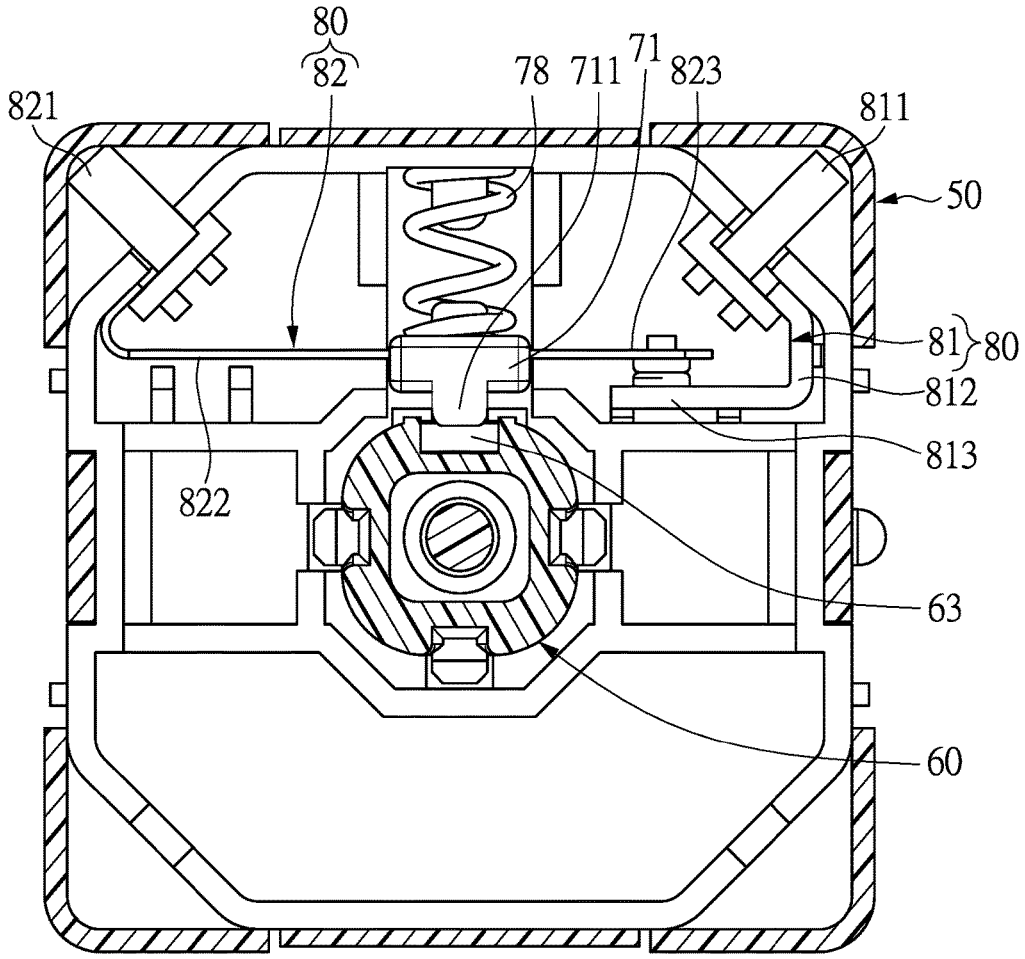
FIG. 4D is a cross-sectional view of the mechanical switch structure along a horizontal surface in a pressed state of the present disclosure.

Referring to FIG. 4A and FIG. 4B, the electrical conduction of the mechanical switch structure is introduced as follows. The initial surface 630 and the rear surface 633 are parallel to the pressing direction, and the initial surface 630 is closer to the abutting unit 71 than the rear surface 633. Reference is next made to FIG. 4C and FIG. 4D, which are cross-sectional views of the mechanical switch structure along a horizontal surface in a non-pressed and a pressed state, in cooperation with FIG. 4A and FIG. 4B. When the keycap 10 is pressed down to the bottommost position, the abutting unit 71 brings the second extending portion 822 of the second conducting arm 82 to move toward the guiding unit 60, so that the second contacting portion 823 moves forward to touch the first contacting portion 813 to produce an electrical conduction.

It should be noted that the receiving housing 50 further has a receiving space 53, which can be used to receive an illuminating element, such as an LED 531, as shown in FIGS. 4A and 4B. In addition, the mechanical switch structures can receive LEDs 531 of different colors.

Figure 5:
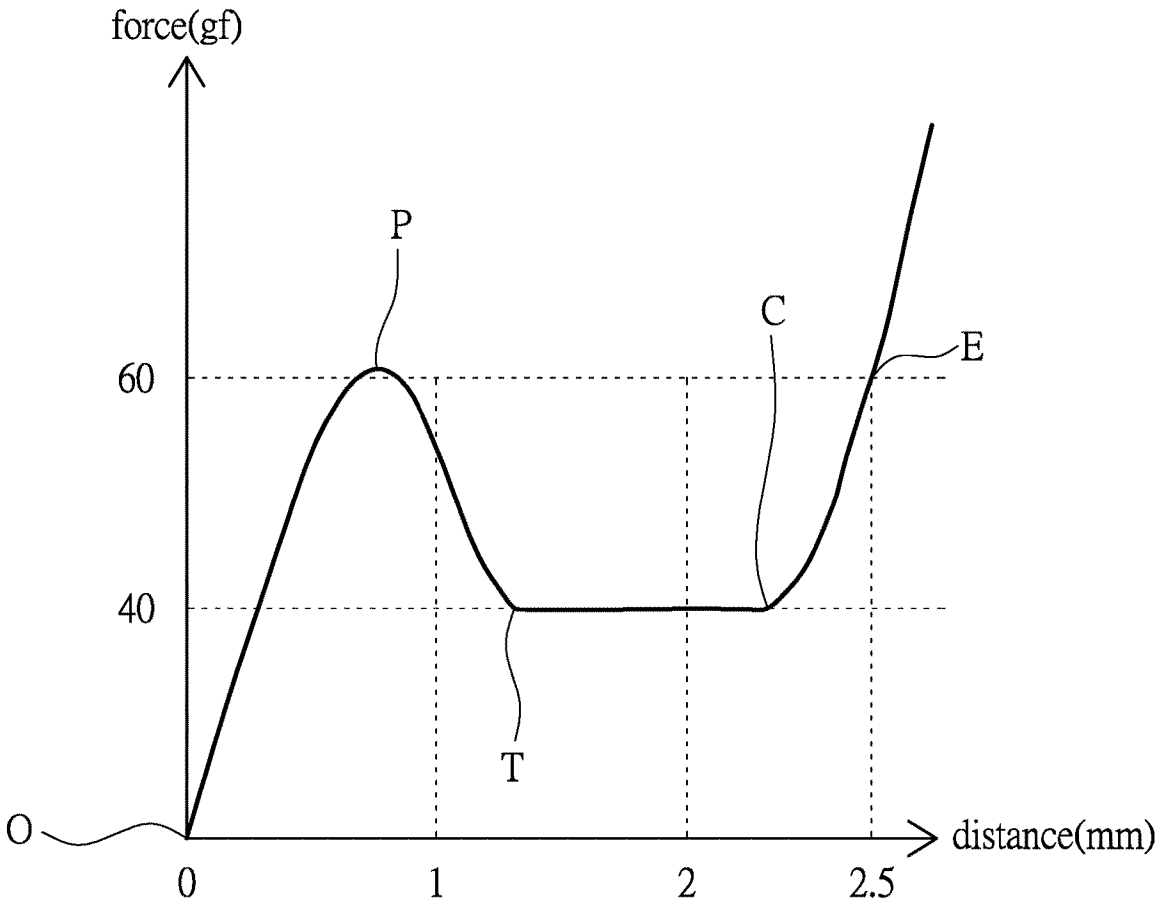
FIG. 5 is a force-stroke diagram of the mechanical switch structure of the present disclosure.
Figure 6:
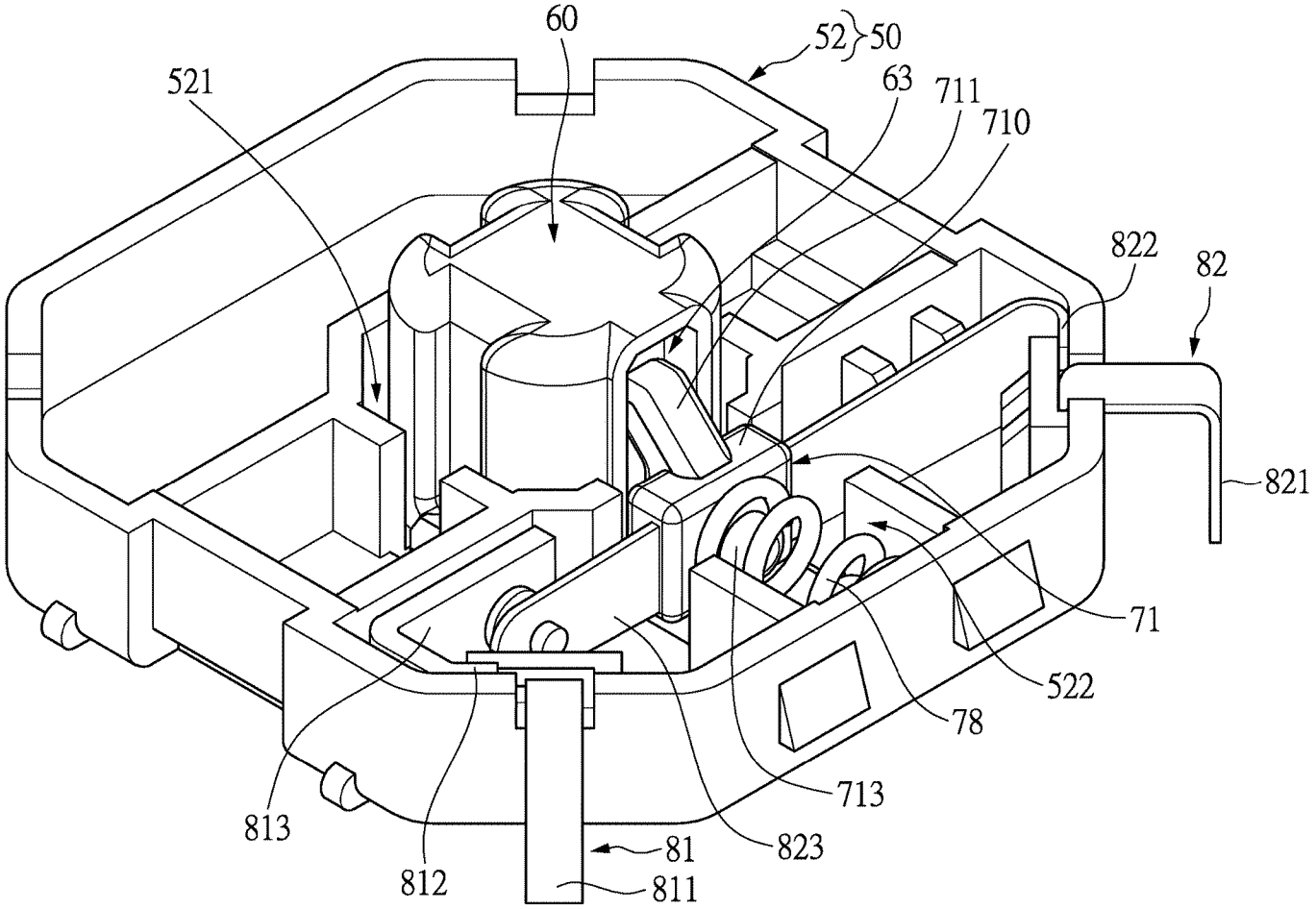
FIG. 6 is a partial perspective view of a receiving housing of the mechanical switch structure of the present disclosure.

Reference is made to FIG. 5, which is a force-travel diagram (also known as a force-displacement curve) of the mechanical switch structure during a pressing stroke according to the present disclosure. The force-travel diagram can express a variation process of force when the keycap is pressed by a user's finger. The horizontal axis of the force-stroke diagram, or the X axis, represents a travel distance of a downward stroke action on the keycap (unit: mm). The longitudinal axis, or the Y axis, represents a force applied on the keycap (unit: gram-force, i.e., gf). The point "O" represents the original point, the point "P" represents the peak point; the point "C" represents the contact point, and the point "E" represents the end point. Referring to FIG. 4A and FIG. 4B, during the pressing process of the keycap 10, the initial surface 630 is abutted against the abutting unit 71 in the initial state of the process, as represented by the original point O in FIG. 5. As the keycap 10 is pressed, the guiding unit 60 is continuously lowered, while the first sloping surface 631 is continuously abutted against the abutting unit 71. The second elastic unit 78 of this embodiment is a compression spring, which is gradually compressed by the first sloping surface 631 and exerts a reverse force on the guiding unit 60. The reverse force produces an upward component force acted on the first sloping surface 631, so that the keycap 10 suffers an increasing resistant force from the original point O to the peak point P, as shown in FIG. 5, and the travel displacement is from 0 mm to about 0.8 mm.

The keycap 10 is continuously pressed until the abutting unit 71 abuts against the transition of the first sloping surface 631 and the second sloping surface 632, as represented by the peak point P in FIG. 5. Then, the second sloping surface 632 is continuously abutted against the abutting unit 71, and the second elastic unit 78 is gradually recovered along the second sloping surface 632, so that the elastic force applied on the guiding unit 60 is gradually reduced, as signified by the downward curve after the peak point P in FIG. 5. In this embodiment, the absolute value of the slope of the second sloping surface 632 can be smaller than the absolute value of the slope of the first sloping surface 631.

Afterwards, the abutting unit 71 is moved from the second sloping surface 632 to the rear surface 633. The rear surface 633 of this embodiment is an upright surface so that the elastic force of the second elastic unit 78 is maintained without change. Reference is next made to the horizontal section from the inflection point T to the contact point C in FIG. 5, which provides a noticeable tactility of step difference. The contact point C represents that an electrical conduction of the mechanical switch structure is provided. After the conduction, the keycap 10 and the guiding unit 60 are depressed to the bottommost position, and the resistant force is gradually increased until the end point E in FIG. 5.

In FIG. 5, the peak point P and the contact point C both affect the pressing tactility of the mechanical switch structure. The pressing tactility can usually be examined by the following pressure formula as an objective data.

Snap ratio (or Click ratio) formula of key-press pressure=((Peak Force)−(Contact Force))/peak force*100%.

In this embodiment, the snap ratio of key-press pressure is about 40%. The conventional mechanical switch usually has a compression spring arranged under the keycap, which is spring type structure. Its force-travel diagram has a curve between the peak point and the contact point, and a slope line with gradual resistance, which does not have a horizontal section as shown in FIG. 5, without a noticeable tactility of step difference.

The present disclosure has features and functions as follows. The mechanical switch structure of the present disclosure can provide a noticeable tactility of step difference, because the hillside portion 63 of the guiding unit 60 is abutted against the abutting unit 71 of the resistance module 70, and the hillside portion 63 has an undulation surface facing the abutting unit 71.

In addition, by the first conducting arm 81 and the second conducting arm 82, the mechanical switch structure of the present disclosure could provide better conductive effect and longer lifespan.

Moreover, the mechanical switch structure of the present disclosure could reduce the total height thereof by virtue of the scissor unit 30, and could reduce the key-press travel to 2.5 mm. Furthermore, a better operation stability when pressing the keycap can also be provided by virtue of the guiding unit 60.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A mechanical switch structure, comprising:

a keycap;

a base plate, disposed under the keycap, having a guiding opening;

a scissor unit, arranged between the keycap and the base plate, to guide the keycap upward or downward along a pressing direction;

a receiving housing, connected to a bottom of the base plate, the receiving housing having a first accommodation corresponding to the guiding opening, and a second accommodation formed at one side of the first accommodation;

a guiding unit, movably received in the first accommodation along a pressing direction of the keycap, and disposed in the guiding opening; wherein the guiding unit is formed with a hillside portion on a periphery thereof;

a first elastic element, having two ends respectively attached to the guiding unit and the first accommodation, to provide the guiding unit an elastic force parallel to the pressing direction; and a resistance module, having an abutting unit and a second elastic unit, the abutting unit being abutted against the hillside portion of the guiding unit, and in which the hillside portion has an undulation surface facing the abutting unit; wherein the second elastic unit is received in the second accommodation and provides the abutting unit with an elastic force toward the guiding unit; wherein the abutting unit is abutted against the undulation surface of the hillside portion to provide different resistive forces during a pressing stroke of the keycap.

2. The mechanical switch structure as claimed in claim 1, wherein the base plate has a plurality of linking portions protruded toward the keycap, wherein a bottom of the keycap has a plurality of connecting portions, wherein the scissor unit has a first frame and a second frame pivotally connected to the first frame, and wherein two sides of the first frame and two sides the second frame are connected to the linking portions and the connecting portions, respectively.

3. The mechanical switch structure as claimed in claim 2, wherein the base plate has a pair of engaging flaps, the pair of engaging flaps extending curvedly and downward from two sides of the base plate and being fixedly engaged with the receiving housing.

4. The mechanical switch structure as claimed in claim 1, wherein the hillside portion of the guiding unit from the bottom of the guiding unit toward the keycap in order has an initial surface parallel to the pressing direction, a first sloping surface connected to the initial surface, a second sloping surface curvedly connected to the first sloping surface, and a rear surface extending from the second sloping surface parallel to the pressing direction.

5. The mechanical switch structure as claimed in claim 4, wherein a slope of the first sloping surface related to the pressing direction is different from a slope of the second sloping surface related to the pressing direction, and wherein the initial surface is closer to the abutting unit than the rear surface.

6. The mechanical switch structure as claimed in claim 1, wherein the receiving housing includes an upper housing and a lower housing, and the upper housing has an enclosing wall protruded upward therefrom, wherein the guiding unit is a hollow column and is movably passed through the enclosing wall, and a top of the guiding unit contacts a bottom of the keycap, wherein the guiding unit has a plurality of guiding grooves formed on a periphery thereof, and a plurality of blocking portions, the blocking portions are respectively protruded from a bottom end of the guiding grooves, and wherein the enclosing wall has a plurality of stopping protrusions protruded inward, the stopping protrusions are respectively located in the guiding grooves so as to prevent the guiding unit from dislocating away from the receiving housing.

7. The mechanical switch structure as claimed in claim 6, wherein the upper housing of the receiving housing has a plurality of side walls extended downward, and a pair of retaining tabs extended downward, and wherein the pair of retaining tabs are engaged with the lower housing, the height of the side walls is lower than the height of the lower housing.

8. The mechanical switch structure as claimed in claim 1, wherein the first accommodation has a guiding post, and the first elastic element is sleeved on the guiding post, wherein the guiding unit is put on the first elastic element.

9. The mechanical switch structure as claimed in claim 1, wherein a moving direction of the abutting unit is substantially perpendicular to the pressing direction, wherein the abutting unit has a main portion, and an upper abutting portion protruded from the main portion toward the guiding unit, the upper abutting portion being near the guiding opening of the base plate and continuously abutted against the hillside portion.

10. The mechanical switch structure as claimed in claim 9, wherein the abutting unit further includes a holding portion formed at one side of the main portion, and a lower abutting portion protruded from the main portion toward the guiding unit near the upper abutting portion, wherein the holding portion is opposite to the upper abutting portion and fixed to one end of the second elastic unit, the lower abutting portion is near a bottom of the receiving housing, so that when the keycap is pressed to a bottommost position, the lower abutting portion is abutted against the hillside portion.

11. The mechanical switch structure as claimed in claim 10, wherein the second accommodation further includes a protruding rod, and another end of the second elastic unit is fixed to the protruding rod.

12. The mechanical switch structure as claimed in claim 1, further comprising a first conducting arm and a second conducting arm, the second conducting arm fixedly connected to the abutting unit, the first conducting arm positioned at one side of the abutting unit, so that when the abutting unit is abutted against the hillside portion and is moved, the abutting unit pushes the second conducting arm against the first conducting arm to produce a pressing signal.

13. The mechanical switch structure as claimed in claim 12, wherein the first conducting arm is received in the receiving housing, and the first conducting arm has a first soldering portion extending outside the receiving housing, a first extending portion extending from the first soldering portion, and a first contacting portion being disposed at an end of the first extending portion.

14. The mechanical switch structure as claimed in claim 13, wherein the second conducting arm is received in the receiving housing, and the second conducting arm has a second soldering portion fixed to a side of the second accommodation and extended outside the receiving housing, and wherein the second extending portion extends from the second soldering portion, and the second contacting portion extends from the second soldering portion and is near the first contacting portion, the second extending portion passing through the abutting unit.

* * * * *